United States Patent [101]

Hoople

[11] 4,054,876

[45] Oct. 18, 1977

[54] CAVITY ANTENNA

[75] Inventor: Gary R. Hoople, San Jose, Calif.

[73] Assignee: The United States of America as represented by the Secretary of the Navy, Washington, D.C.

[21] Appl. No.: 662,481

[22] Filed: Mar. 1, 1976

[51] Int. Cl.[2] ..... H01Q 13/00

[52] U.S. Cl. ..... 343/789; 343/830

[58] Field of Search ..... 343/789, 767, 786, 830

[56] References Cited

U.S. PATENT DOCUMENTS

| | | | |
|---|---|---|---|
| 2,636,987 | 4/1953 | Dorne | 343/789 |
| 3,262,119 | 7/1966 | Sisson | 343/789 |
| 3,534,376 | 10/1970 | Woo | 343/789 |

*Primary Examiner*—Eli Lieberman

*Attorney, Agent, or Firm*—R. S. Sciascia; Charles D. B. Curry; Elliott N. Kramsky

[57] ABSTRACT

A cavity antenna having an aperture which may be mounted flush to the ground plane. A chamber positioned above a rectangular resonant cavity allows the antenna to achieve normal bandwidth and normal gain with a very thin cavity depth.

10 Claims, 7 Drawing Figures

CAVITY ANTENNA

BACKGROUND OF THE INVENTION

1. Field of the Invention.

The present invention relates to the transmission of electromagnetic energy. In particular it relates to antennas designed for flush mounted operation.

2. Description of the Prior Art.

The limitations of thin aperture antennas have been theoretically defined by D. Rhodes in the *IEEE Transactions on Antennas and Propagation*, May, 1972, pages 318–325. Significant results of his derivations show that the depth of a cavity does not influence gain or bandwidth. However, the achievement of a cavity antenna of minimal depth, a very desirable design objective, is complicated by the generation of a large amount of capacitance. Such capacitance interferes with the transfer of electromagnetic energy into free space.

Previous design art for removing the capacitance associated with shallow cavities has consisted of parasitic elements (stubs, tuning screws) in the E plane of the cavity. Often, in these cavities, no space exists for such parasitic elements. An alternate design approach has been to modify the E plane by narrowing some portion of the antenna aperture. This method tends to narrow the antenna frequency bandwidth and squint the radiation pattern for a circular polarized source. Another design method eliminates capacitance by not extending the cavity beyond the probe (*IEEE Transactions on Antennas and Propagation, January*, 1975, pages 1–7). This method restricts window design for flush mounted applications.

The present invention achieves a very thin cavity antenna the transfer of energy from which overcomes the capacitance introduced. A chamber placed at the top of the cavity having a metallic probe located therein serves to minimize the effect of capacitance due to the minimal cavity depth.

SUMMARY OF THE INVENTION

Briefly, the present invention comprises a cavity antenna having an aperture which may be flush mounted to the ground plane. A chamber positioned above a rectangular resonant cavity allows the antenna to achieve normal bandwidth and normal gain with a very thin cavity depth.

OBJECTS OF THE INVENTION

An object of this invention is to provide a cavity antenna of minimal cavity depth having normal gain and normal bandwidth.

Another object of this invention is to achieve the above object by means of an antenna capable of efficient radiation of electromagnetic radiation.

Yet another object of this invention is to achieve an efficient electromagnetic radiation system of minimal bulk and complexity.

Other objects, features and advantages will appear in the subsequent detailed description which is accompanied by drawings wherein like numerals throughout the figures indicate like parts.

DESCRIPTION OF THE PREFERRED EMBODIMENT

Figure 1:
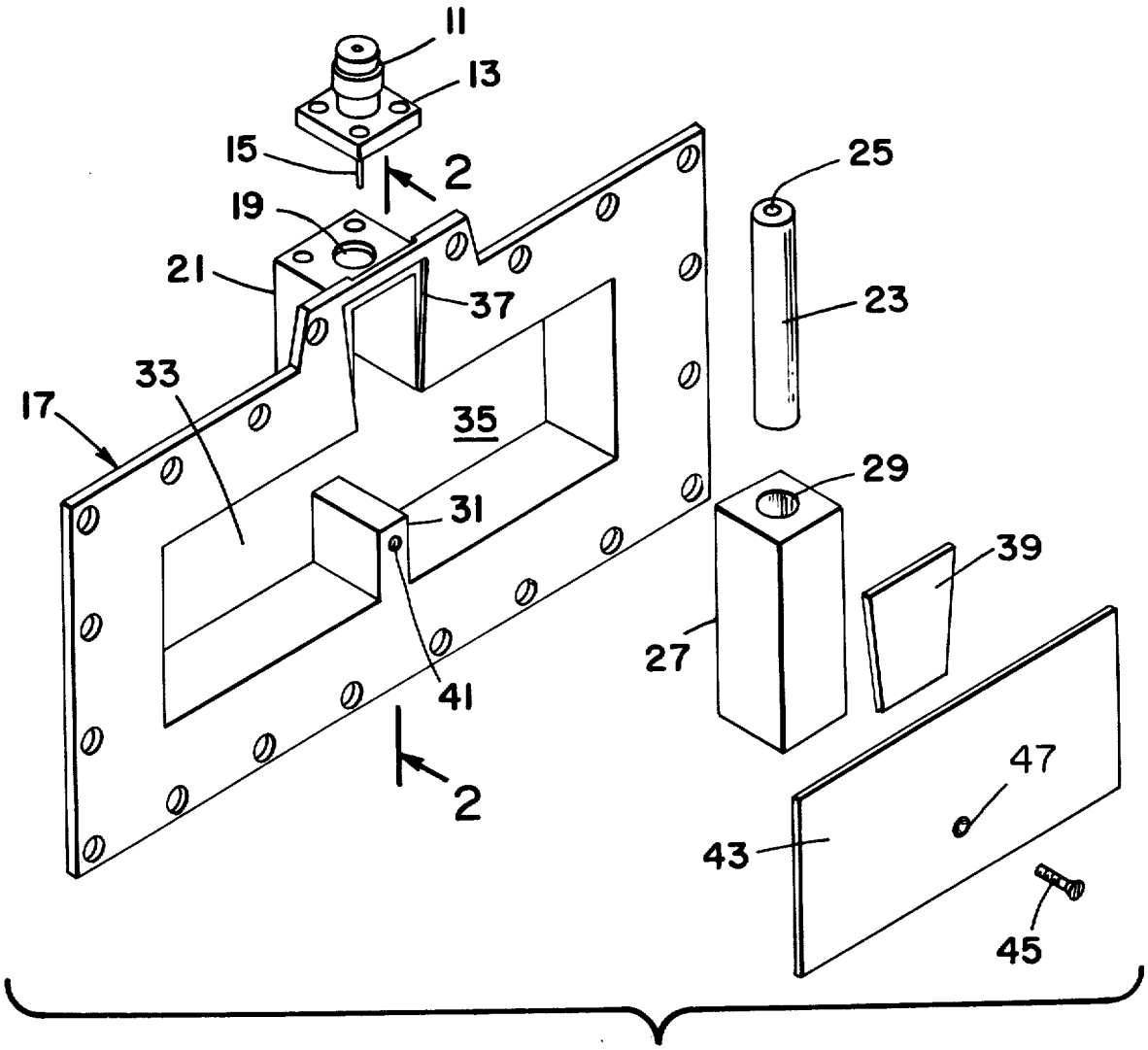
FIG. 1 is a partially exploded view of the present invention.

Turning now to FIG. 1, there is shown the present invention in exploded view. A coaxial transmission line 11 is joined to the antenna at input plane 13. The plane 13 has an aperture therethrough to allow passage of line 11 and serves as a point of entry for the line 11 into the system. Stem 15 (center conductor of transmission line 11) extends through plane 13 to provide an electrical connection between transmission line 11 and the interior of the antenna.

The antenna body 17 has a hole 19 to provide a point of entry for the stem 15 into the chamber portion 21 of antenna body 17. The input plane 13, seated atop hole 19 of chamber portion 21, allows stem 15 to extend into the interior of chamber 21. A probe 23 made of copper or other conducting material and having an open shaft 25 therethrough is fitted tightly to stem 15. The probe 23, in turn, is fitted into a block 27 of dielectric material. A cylindrical shaft 29 provides a tight fit with probe 23. The length of the block 27 is adequate to fit the interior of the top of chamber portion 21 and rest upon stub 31 of antenna body 17. The block 27 of dielectric material serves the natural function of electrically lengthening the height of probe 23 and insulating it from surrounding metallic structures.

Figure 2:
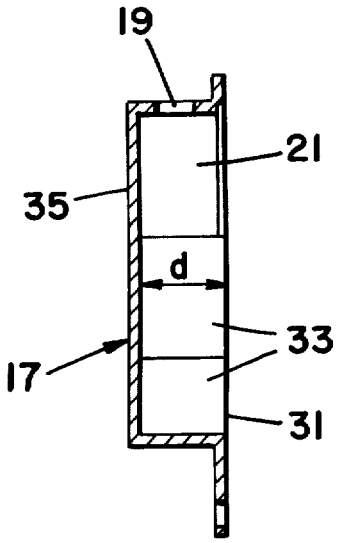
FIG. 2 is a side sectional view of the antenna body of the present invention.

The antenna body 17 is designed to contain both a chamber portion 21 and a radiating cavity 33. The rear of the entire antenna body 17 comprises solid metallic wall 35 as is illustrated in side sectional view in FIG. 2. A groove 37 exists in the chamber portion 21 to allow contact of metallic upper plate 39. The upper plate 39 extends the full height and width of the interior of chamber portion 21 to provide a fully enclosed chamber.

A hole 41 exists in stub 31 of antenna body 17. Hole 41 serves as a point of attachment for lower metallic plate 43 by means of fastener 45 through hole 47 which is aligned with hole 41. Lower plate 43 is dimensioned to leave a space between the edges of radiating cavity 33 and the plate 43. Such space must be present for the efficient transfer of energy to free space. If the cavity 33 were to be fully enclosed by lower plate 43 a standing wave would result within antenna body 17 and no transfer of energy to free space would occur.

In order that the present invention may be better understood, a theoretical explanation will now be given. It is to be understood, however, that this theoretical explanation is given merely for the purpose of exposition and in order that the invention may be better appreciated. While this theoretical explanation is believed to be correct, it is not of necessity complete, nor does the operation of the invention depend upon its accuracy or otherwise.

Figure 3:
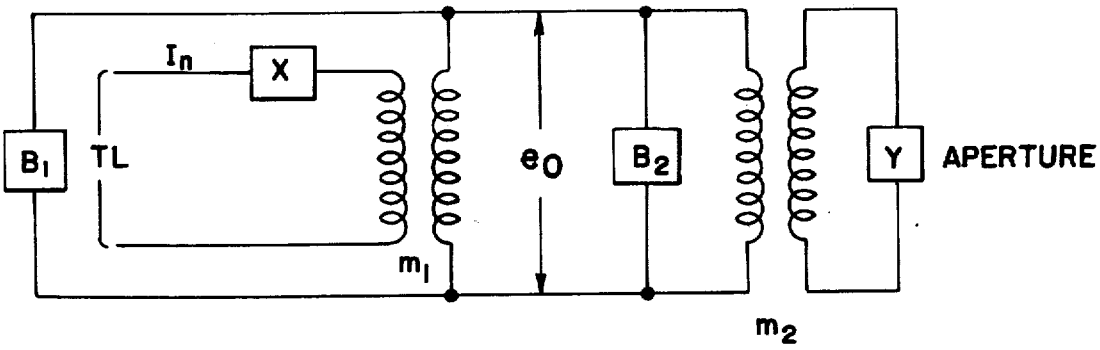
FIG. 3 is a schematic representation of the equivalent circuit of the present invention.

A schematic view of the equivalent circuit for the present invention is shown in FIG. 3. The coaxial transmission line from the source (not shown) is identified by the lines TL. The reactive portions of the coaxial chamber portion 21 and probe 23 are combined and denoted X. $M_1$ represents the inductive transfer of energy from the probe 23 to radiating cavity 33. $B_1$ represents the susceptive component due to the short circuit formed by the back wall 35 of the antenna body 17 while $B_2$ represents the susceptive component of the admittance due to the open circuit formed by the air gap between the antenna body 17 and lower metallic plate 43. $M_2$ symbolizes the transfer of energy from cavity mode to free space traveling wave mode through the aperture existing at the face of radiating cavity 33.

It is known that $B_1$, the susceptive component of admittance, due to the short circuit formed by back wall 35, is inductive and that $B_2$, the corresponding component of admittance due to the open circuit between antenna body 17 and lower plate 43, is capacitive. The corresponding analytic expressions are:

$$B_1 = (i/z_o \tan kd)$$

$$B_2 = (-i/z_o \operatorname{cotan} kd)$$

where $k = 2\pi/\lambda$, $z_o$ is the internal characteristic impedance of the cavity and $d$ is the distance from the probe 23 to the back wall 35 and upper plate 39.

The reactive component of impedance due to the combined effects of chamber portion 21 and probe 23 is inductive and may be expressed as:

$$X = (z_o/2I_n) \int\int J_s \cdot e_o \, ds$$

where $I_n$ is the input current (coaxial transmission line 11), $e_o$ is the dominant cavity mode vector (voltage vector in cavity), $J_s$ is the probe current vector modified by the unique chamber portion 21 design to change the intergral of the above expansion from normally capacitive to inductive, and $ds$ represents an infinitesimal element of the interior surface of the cavity.

The expressions for $B_1$ and $B_2$ indicate that as $d$ is decreased (i.e., the thin cavity condition is approached), $B_2$ approaches zero and $B_1$ approaches infinity. Thus a very large capacitive element of impedance, $1/B_2$, is generated, preventing the transfer of energy to a free space traveling wave from the cavity. This large capacitive component will not be cancelled out by $1/B_1$, which becomes negligible for small $d$. However, by appropriate design of chamber portion 21, an inductive component $1/X$ is placed in parallel with $B_2$ to negate the susceptive term and form a resonant cavity circuit. It has been found that the addition and careful design of the relative size of chamber portion 21 allows the antenna to achieve normal bandwidth and normal gain with a cavity depth of 0.07 of the free space wavelength or 0.02 of the cavity wavelength. Existing cavity backed antennas require up to a 0.25 cavity wavelength depth. The inductive reactance, X, caused by the addition of chamber portion 21 is believed to offset the inherent capacitive effect $1/B_1$ due to thin cavity (small $d$) design.

Figure 4:
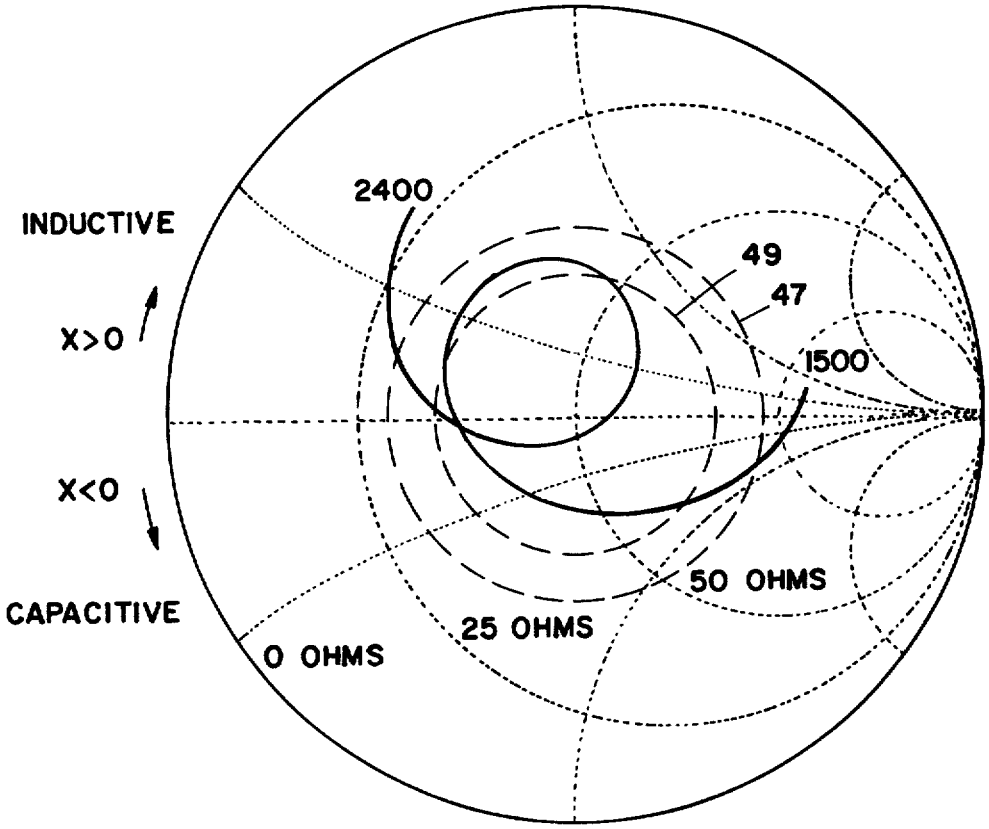
FIG. 4 is a Smith chart of the impedance characteristics of the present invention.

FIG. 4 is a Smith chart showing in polar form the impedance characteristic of an antenna having a depth of 0.020 cavity wavelength near the lowest operating frequency and a dielectric block 27 of relative dielectric constant 4.3 according to the present invention over the range of frequencies from 1500 MHz to 2400 MHz. Values denoted "X" refer to the value of the reactance component of antenna impedance, those positive denoting an overall inductive value and those negative a capacitive value. The interior of the circle 47 indicated on the graph represents the region of less than 2.75:1 standing wave ratio. Such a region indicates an approximate 1 db loss in radiation which generally constitutes practical efficiency. It can be seen that the region encompassed covered 1540 MHz to 2290 MHz, indicating a bandwidth of approximately 49 percent. Circle 49 indicates the region of the more exacting standard of 2:1 standing wave ratio for which a range of frequencies from 1575 MHz to 2235 MHz exists indicative of a 42 percent bandwidth.

Figure 5:
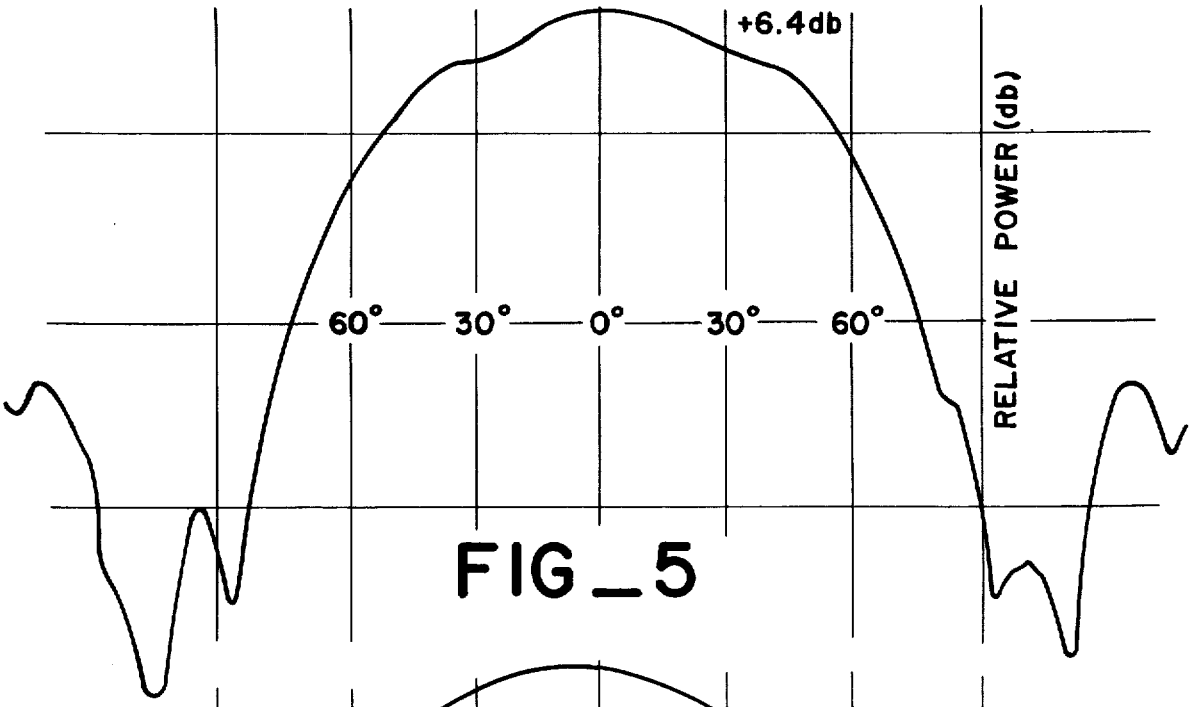
FIG. 5 presents an H plane radiation pattern of an antenna according to the present invention at the frequency of 2250 MHz.
Figure 6:
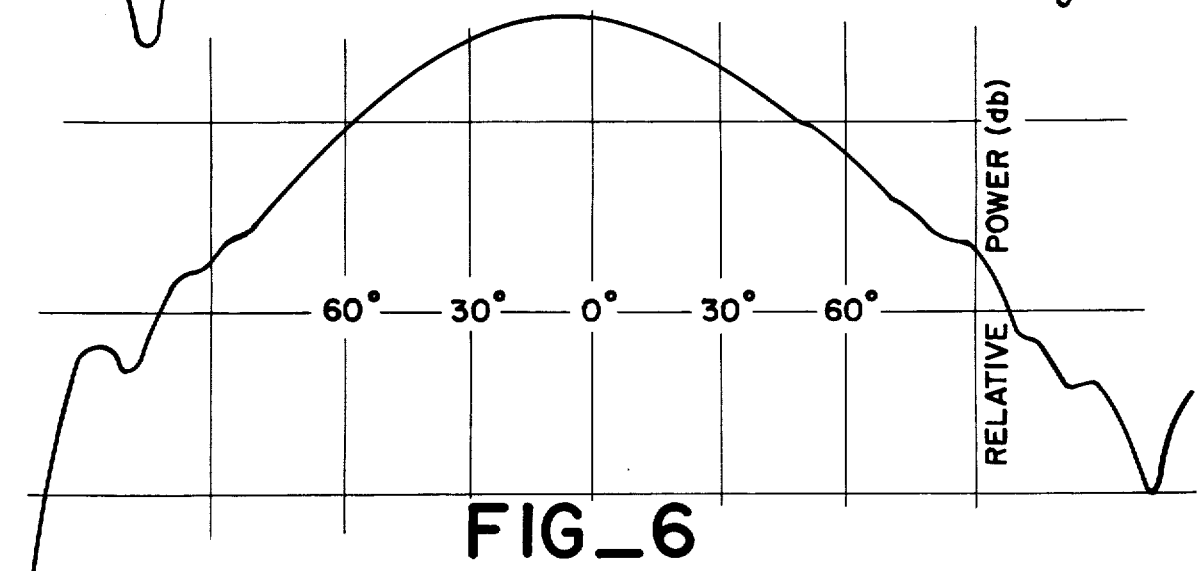
FIG. 6 presents an H plane radiation pattern of an antenna according to the present invention at the frequency of 1575 MHz.
Figure 7:
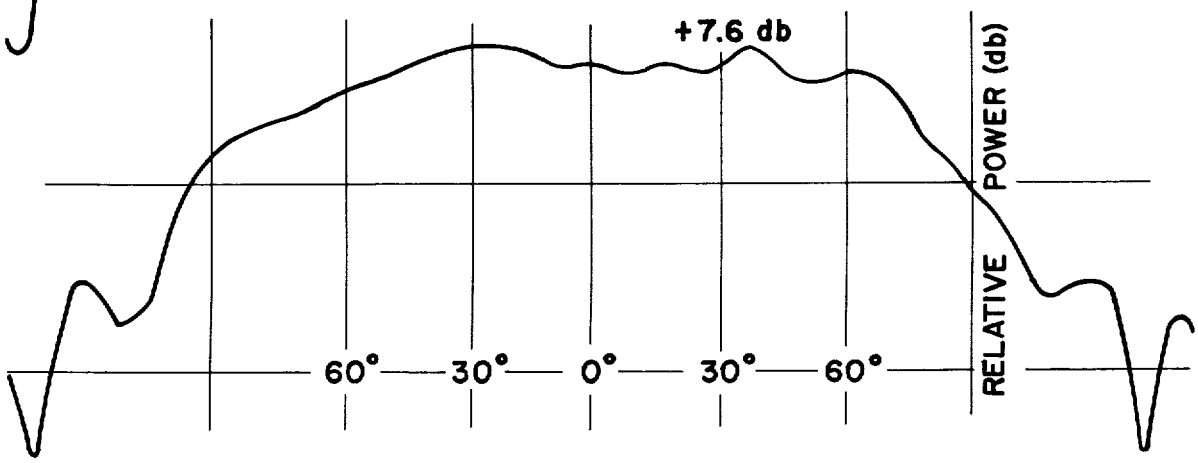
FIG. 7 presents an E plane radiation pattern of an antenna according to the present invention at the frequency of 1575 MHz.

There is presented in FIGS. 5 and 6 H plane radiation patterns at frequencies of 2250 MHz and 1575 MHz, respectively, for an antenna according to the present inventive concept. FIG. 7 represents an E plane pattern at a frequency of 1575 MHz.

Radiation patterns were measured in an anechoic chamber with isotropic gain references established according to the gain substitution method.

The adaptability of the present invention to omnidirectional usage and applications is evident in which the H plane 3db points are seen to be separated by 85° to 94° while the 10db points are shown to be 125° to 150° apart. Also of significance with respect to efficient radiation is the fact that a positive gain near theoretical gain is shown in FIGS. 5, 6 and 7.

Thus it can be seen that the present invention achieves an efficiently radiating cavity antenna of minimal depth having normal gain and normal bandwidth characteristics.

What is claimed is:

1. In an antenna of the type having an input channel to receive electromagnetic energy transmitted by a coaxial cable and a cavity having an aperture to allow the radiation of said electromagnetic energy into free space wherein the improvement comprises:

a. a chamber located at the top of said cavity and interposed between said input channel and said cavity and commuting interiorly therewith;

b. a metallic probe positioned interior to said chamber, said chamber being dimensioned such that the reactive component of impedance due to the combined effects of said chamber and said probe is inductive in an amount to negate the susceptive component of admittance of said cavity; and c. said probe in electrical connection with said coaxial cable.

2. An antenna as described in claim 1 wherein said antenna additionally comprises:

a. a block of dielectric material;

b. said block surrounding said probe to insulate said probe electrically from said chamber and from said cavity.

3. In an antenna of the type having an input channel to receive electromagnetic energy transmitted by a coaxial cable and a cavity having an aperture to allow radiation of said electromagnetic energy into free space, the improvement comprising:

a. a chamber located at the top of said cavity and interposed between said input channel and said cavity communting interiorly therewith;

b. a metallic probe positioned interior to said chamber and electrically connected with said coaxial cable; and c. a block of dielectric material surrounding said probe to insulate said probe electrically from said chamber and from said cavity, said block being so dimensioned as to fill the interior of said chamber.

4. An antenna as described in claim 3 wherein the axis of said chamber top is coaxial with the transverse axis of said cavity.

5. An antenna as described in claim 4 wherein said cavity additionally comprises a metallic stub at the bottom of said cavity protruding into said cavity.

6. An antenna as described in claim 5 wherein the bottom of said block of dielectric material abuts the top of said stub.

7. An antenna as described in claim 6 wherein said input channel comprises:

a. a platform of non-conducting material having a passageway therethrough for said coaxial cable;

b. said platform located atop said chamber; and c. said chamber having a hole through its top portion to provide for passage of said coaxial cable therethrough.

8. An antenna as described in claim 7 wherein a removable metallic wall comprises the front portion of said chamber.

9. An antenna described in claim 8 wherein said cavity has a depth of 0.020 cavity wavelength.

10. An antenna as described in claim 9 wherein said block of dielectric material has a relative dielectric constant of 4.3.

* * * * *